US005577754A

United States Patent [19]

Hwu

[11] Patent Number: 5,577,754

[45] Date of Patent: Nov. 26, 1996

[54] ANTI-REVERSE SLIDING MOTION MECHANISM

[76] Inventor: Chyn-Herng Hwu, 1 Fl., No. 14, Alley 65, Lane 134, Sec. 3, Shin-Yi Road, Taipei, Taiwan

[21] Appl. No.: 233,239

[22] Filed: Apr. 26, 1994

[51] Int. Cl.[6] ..... A63C 7/10

[52] U.S. Cl. ..... 280/605; 280/608

[58] Field of Search ..... 280/604, 605, 280/608, 609, 11.14, 11.16; 188/5, 8

[56] References Cited

U.S. PATENT DOCUMENTS

| | | | |
|---|---|---|---|
| 1,714,352 | 5/1929 | Echola | 280/605 |
| 4,083,577 | 4/1978 | Ford | 280/608 |

FOREIGN PATENT DOCUMENTS

| | | | |
|---|---|---|---|
| 0800338 | 7/1936 | France | 280/605 |
| 3126068 | 1/1983 | Germany | 280/605 |
| 3303093 | 8/1984 | Germany | 280/604 |
| 0331354 | 11/1935 | Italy | 280/605 |
| 0042996 | 5/1914 | Sweden | 280/605 |
| 0187456 | 11/1936 | Switzerland | 280/605 |
| 0218388 | 3/1942 | Switzerland | 280/605 |

*Primary Examiner*—Anne Marie Boehler

*Attorney, Agent, or Firm*—Merchant, Gould, Smith, Edell, Welter & Schmidt, P.A.

[57] ABSTRACT

The present invention relates to an anti-reverse sliding motion mechanism which comprises a pair of carriers having a plurality of movable sliding plates disposed therein. As each carrier carrying the plurality of sliding plates subject to a thrust in opposite direction, the sliding plates will extend and move to be in perpendicular to the carrier, thereby producing an anti-thrust resistance force which serve as a opposite force for moving forward. When the carrier subject to a forward pushing force, the anti-reverse sliding plates will move to present a horizontal smooth surface which serves as a sliding surface. By the alternating action of the pair of carriers, a forward driving force will be obtained as a result of the combination of anti-reverse and sliding actions.

6 Claims, 8 Drawing Sheets

ANTI-REVERSE SLIDING MOTION MECHANISM

BACKGROUND OF THE INVENTION

The subject invention is related to an anti-reverse sliding mechanism which comprises a pair of carriers having a plurality of movable anti-reverse sliding plates disposed therein. The anti-reverse sliding plates may move to a sliding position or an anti-reverse position. As the pair of carriers are effected to move in alternation, an anti-reverse action will be produced, and said action will convert to a forward sliding force.

It is known that in almost all forward motions, for example rowing, skiing, running, and walking, a reaction force for moving forward is obtained by applying a force on an acting surface (or object) in opposite direction. Some other sports, such as in skating, a driving force to move forward is obtained due to the center of gravity of the skater's body which inclines forward and the alternating actions of the skates. In rowing, skiing, running and walking, oars, ski sticks, and legs are used respectively to apply forces backward to obtain the reaction forces needed to move forward. In skating, the driving force to move forward is obtained by means of the gradient of a slope, or the sliding effect resulted from the actions between the skater's forwardly inclining body weight and the ground surface.

The two types of motions mentioned above are not entirely different from or opposed to each other. They may operate in combination under some circumstances. For example, in the case of skiing (see FIG. 2), ski sticks are used to provide a thrust force acting in opposite direction. But the center of gravity of the skier's body which inclined forward or the gradient of the slope on which sliding takes place provides the driving force to move forward. In the case of skating (see FIG. 1), to overcome the static friction, the kinetic energy to initiate motion is provided by the serrated portions of the front ends of the ice skates or the rubber blocks in front of the roller skates. Once the forward moving force is obtained, it is only necessary to keep the center of gravity of the body facing toward a particular direction and to move the pair of ice skates or roller skates alternately to maintain the motion.

The motions mentioned above are normally a result of the combination of forward sliding and anti-reverse actions. However, for sliding motion over snow or grass, ski sticks are still needed as tools for pushing forward. Moreover, sliding over the snow or grass normally involves the gradient effect in which potential energy is converted into kinetic energy. Therefore, after one slides down a slope, it is rather difficult for him to climb up the slope because the skis or roller skates he wore are so smooth that no holding force against the ground can be produced.

SUMMARY OF THE INVENTION

It is therefore an object of this invention to provide an anti-reverse sliding mechanism which mitigates the above drawback. The mechanism comprises a pair of carriers having a plurality of movable anti-reverse sliding plates disposed therein. The sliding plates serve as low friction sliding medium as they move to a forward sliding position. As the sliding plates move to an anti-reverse position, a reaction force which may convert to a forward driving force may be obtained.

Another object of the present invention is to provide a sliding carrier which may be used to walk up a slope.

These and other objects, advantages and features of the present invention will be more fully understood and appreciated by reference to the written specification.

BRIEF DESCRIPTION OF THE DRAWINGS

Further understanding of this invention will become more apparent after referring to the following specification and attached drawings in which:

With reference to FIG. 3, there is shown a sliding carrier 1 similar to a ski. The bottom of the carrier 1 presents a smooth surface 11. The smooth surface 11 includes a frame 16 at the center thereof. A plurality of anti-reverse sliding plates 13 linked to one another are disposed within the frame 16. The anti-reverse sliding plates can move as a unit to a horizontal position to present a sliding surface (A). In this way, a smooth surface is formed at the bottom of each carrier 1 as a result of the combination of the sliding surface (A) and the smooth surface 11 (see FIG. 4). Moreover, the sliding, plates can be swung as a unit to a vertical position. In this orientation, each of the sliding plates which stands vertically protrudes beyond the smooth surface 11 so that an anti-thrust surface (B) is formed underneath the sliding carrier 1 (see FIG. 5).

As shown in FIGS. 4 and 5, the anti-reverse sliding plates 13 are disposed within the rectangular frame 16 which is provided within a slot 18 of the sliding carrier 1. The slot 18 is provided with a plurality of discharge openings 12 which are corresponding in number to the anti-reverse sliding plates. The discharge openings 12 penetrate through the top of the sliding carrier 1 so that snow, soil, water, etc. entering the slot 18 through the bottom of the sliding carrier 1 can be expelled through the discharge openings 12.

FIG. 6 shows a second embodiment in accordance with the present invention. This embodiment is different from that of FIG. 3 in that a foot retainer 10 in which the feet of an user may be placed is further provided on the sliding carrier. FIGS. 7 and 8 are cross-sectional views illustrating the internal structure of a portion of the embodiment in details. In the drawings, it is seen that the foot retainer 10 is provided on a force applying lever 18. One end of the lever 18 is pivotally connected to a connecting rod 14 by means of pivot points 19 and 20. As one foot of the user steps backward, the anti-reverse sliding plates will swing to a vertical position from its original horizontal position. In other words, the original sliding surface (A) turns into the anti-thrust surface (B). As the stepping force is acted on by the resisting force resulted from the actions between the anti-thrust surface (B) and the ground (snow surface, ice surface or grass), a forward driving force will be provided for the other foot of the user. Subsequently, as the other foot slides forward, the anti-reverse sliding plates 13 will turn to its horizontal position to present the sliding face (A). Since the sliding surface (A) will produce a sliding effect of minimal friction with the ground, the foot of the user can slide forward, resulting in the forward movement of the body. Then the foot that steps backward can slide forward with the foot lifting off or touching on the ground. The anti-reverse sliding plates 13 swing to present the sliding surface (A) due to changes in the directions of the reaction forces. At this moment, the foot provides the reaction force for anti-thrust since it has been moved to the back, and the direction of reaction force has been changed.

As a result of the motions mentioned above, the anti-reverse sliding plates 13 at the bottom of the sliding carrier 1 may turn to present the sliding surface (A) or the thrust surface (B) in accordance with the changes in directions of reaction forces. In this way, the smooth surface will interact with the engaging surface under the action of sliding friction to produce effective, forward driving force. It is, however, apparent that there will be no change in action under the following two conditions. Firstly, on a continuous running slope, the gravitational acceleration will cause the user with the sliding carriers to slide down the slope continuously, and thus the anti-reverse sliding plates will remain unchanged in the state of presenting the sliding surface. Secondly, on a slope that runs up continuously, as one walks up the slope, the unit of anti-reverse sliding plates will act as a thrust surface as it engages the ground and provide the thrust force for the user to walk up the slope.

Figure 1:
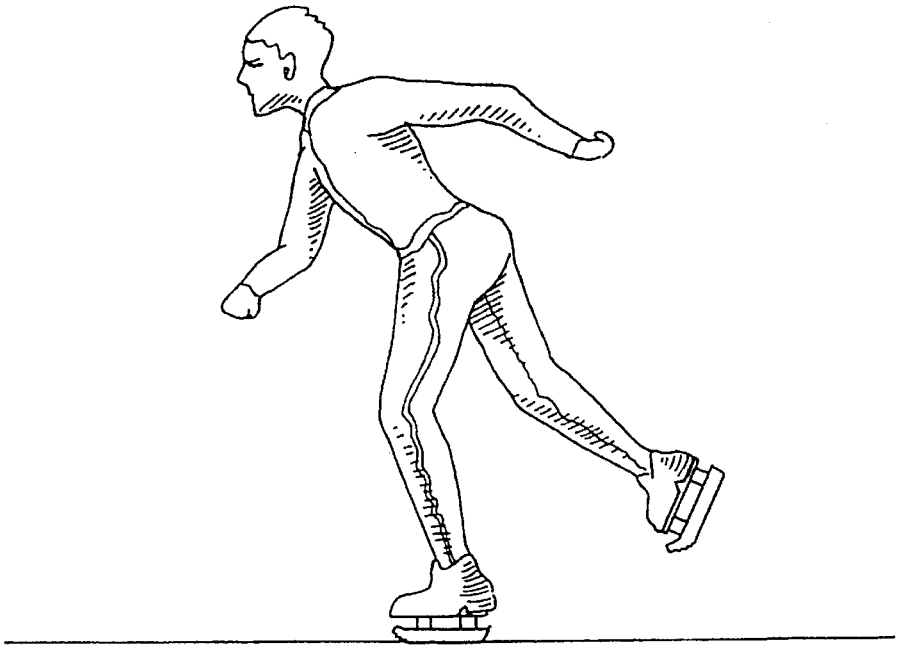
FIG. 1 is a view showing a conventional sport of skating.
Figure 2:
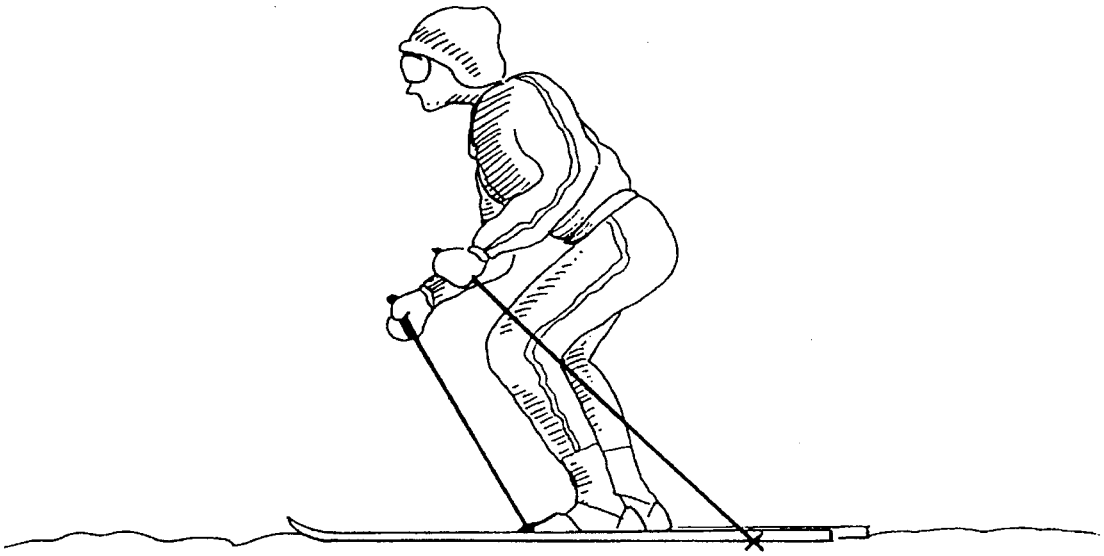
FIG. 2 is a view showing another conventional sport of skiing.
Figure 3:
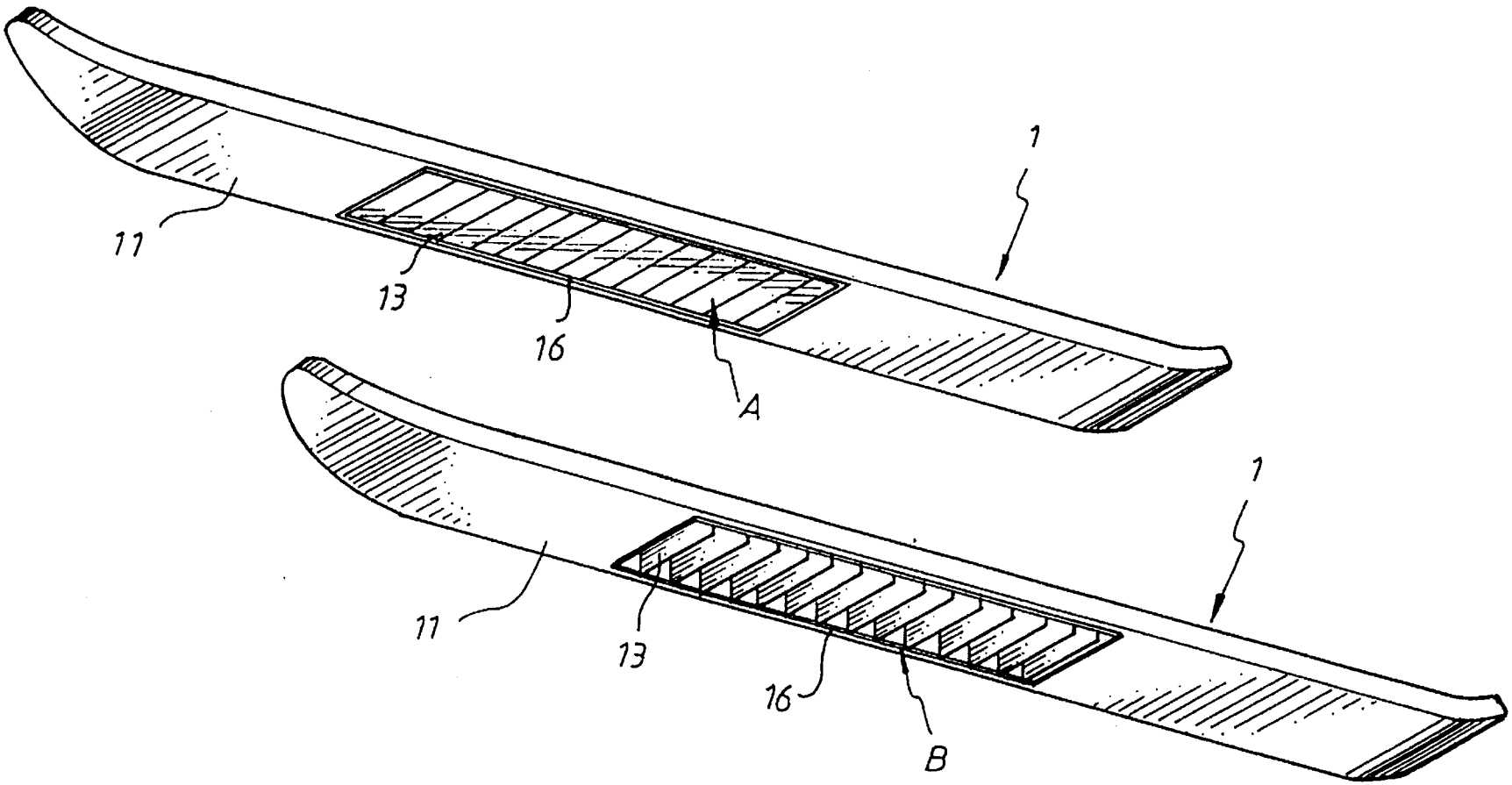
FIG. 3 is a perspective view of an embodiment according to the present invention.
Figure 4:
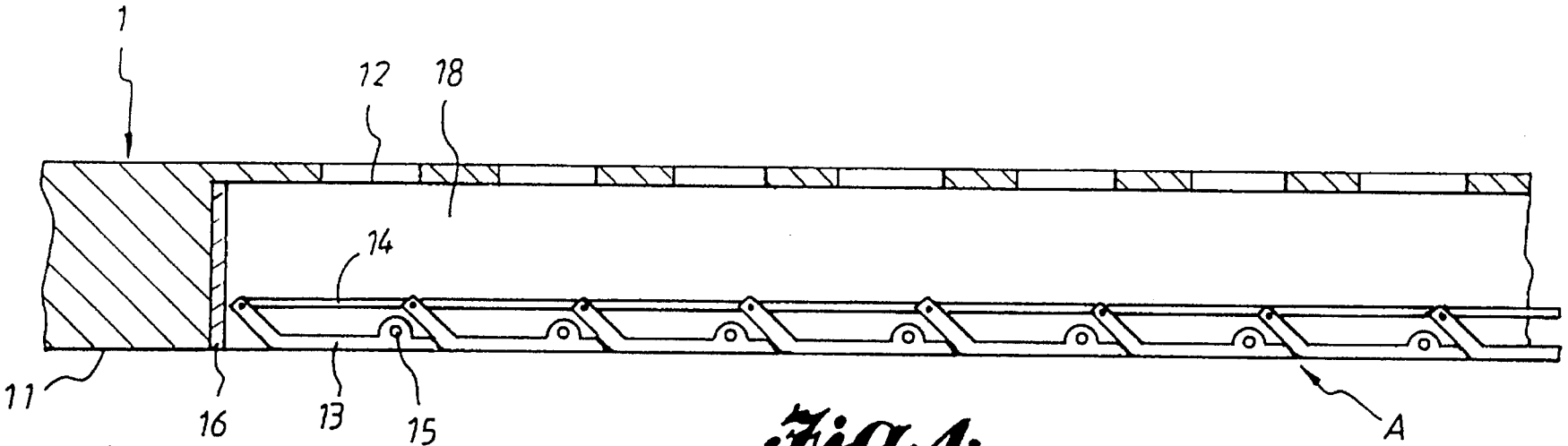
FIG. 4 is a cross-sectional view showing the plurality of anti-reverse sliding plates in accordance with the present invention in a forward sliding position.
Figure 5:
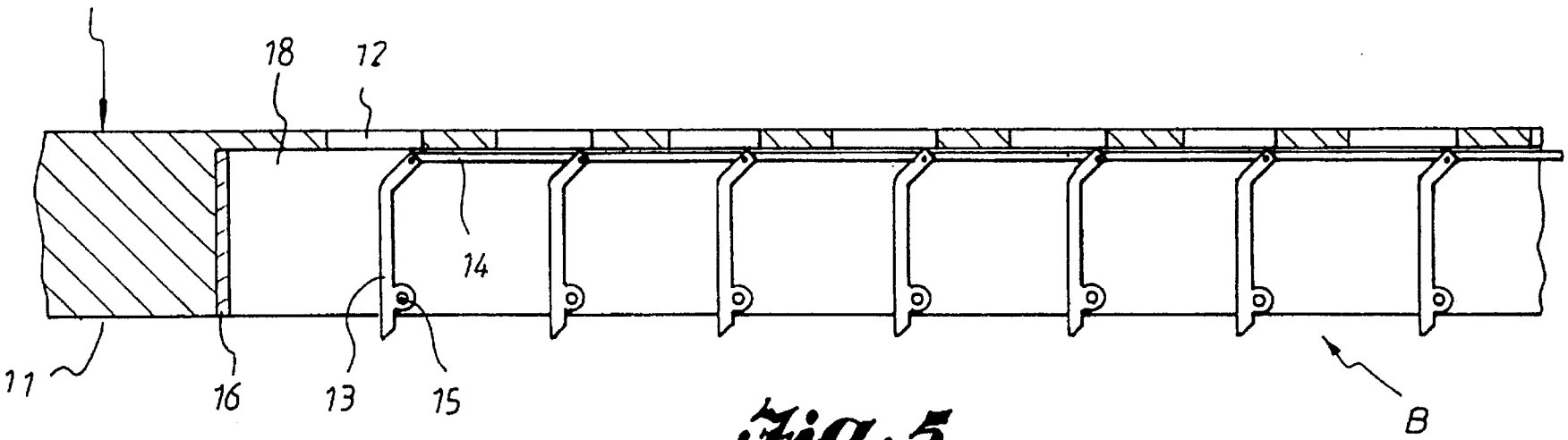
FIG. 5 is a cross-sectional view showing the plurality of anti-reverse sliding plates in accordance with the present invention in an anti-reverse position.
Figure 6:
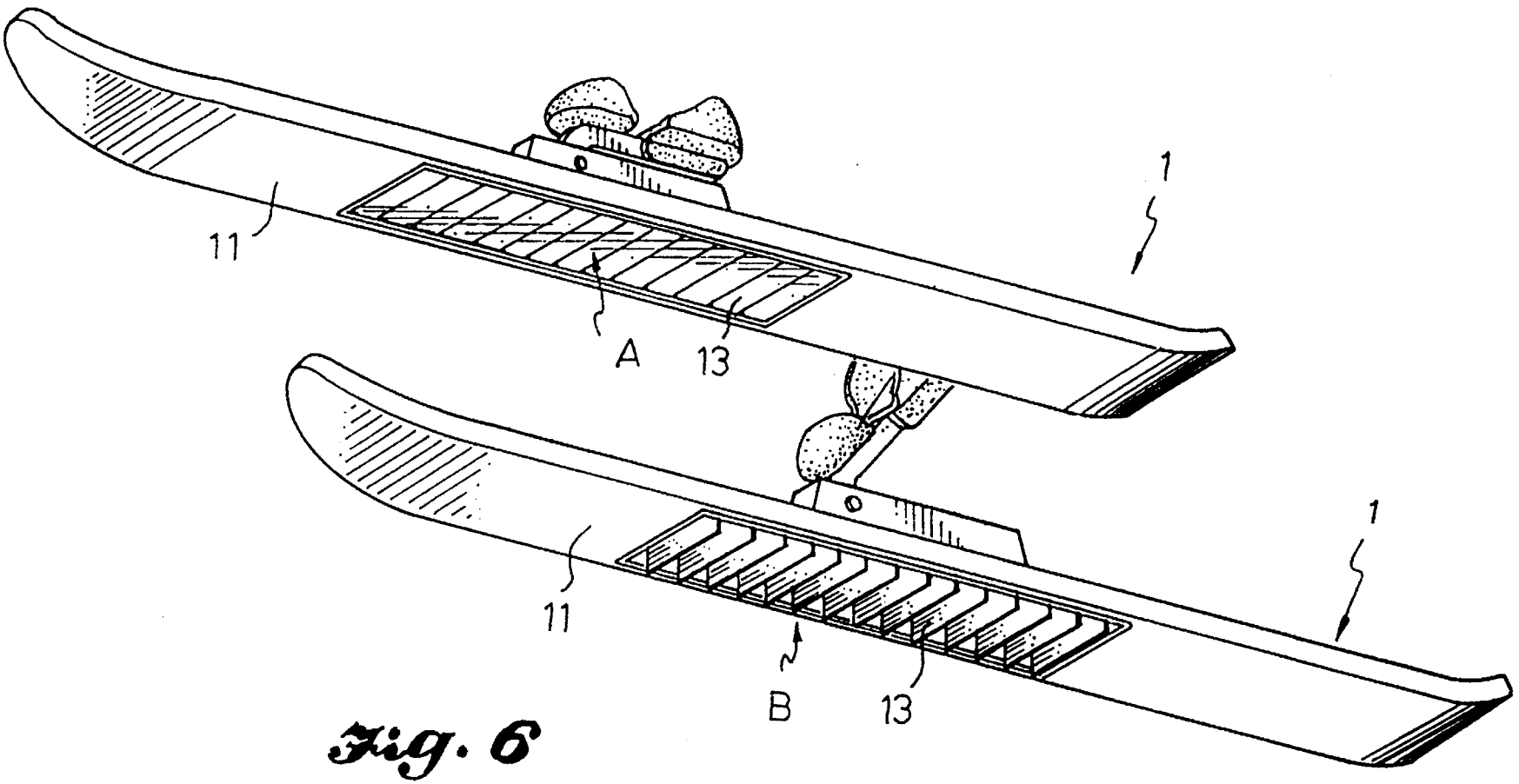
FIG. 6 is a perspective view of another embodiment according to the present invention.
Figure 7:
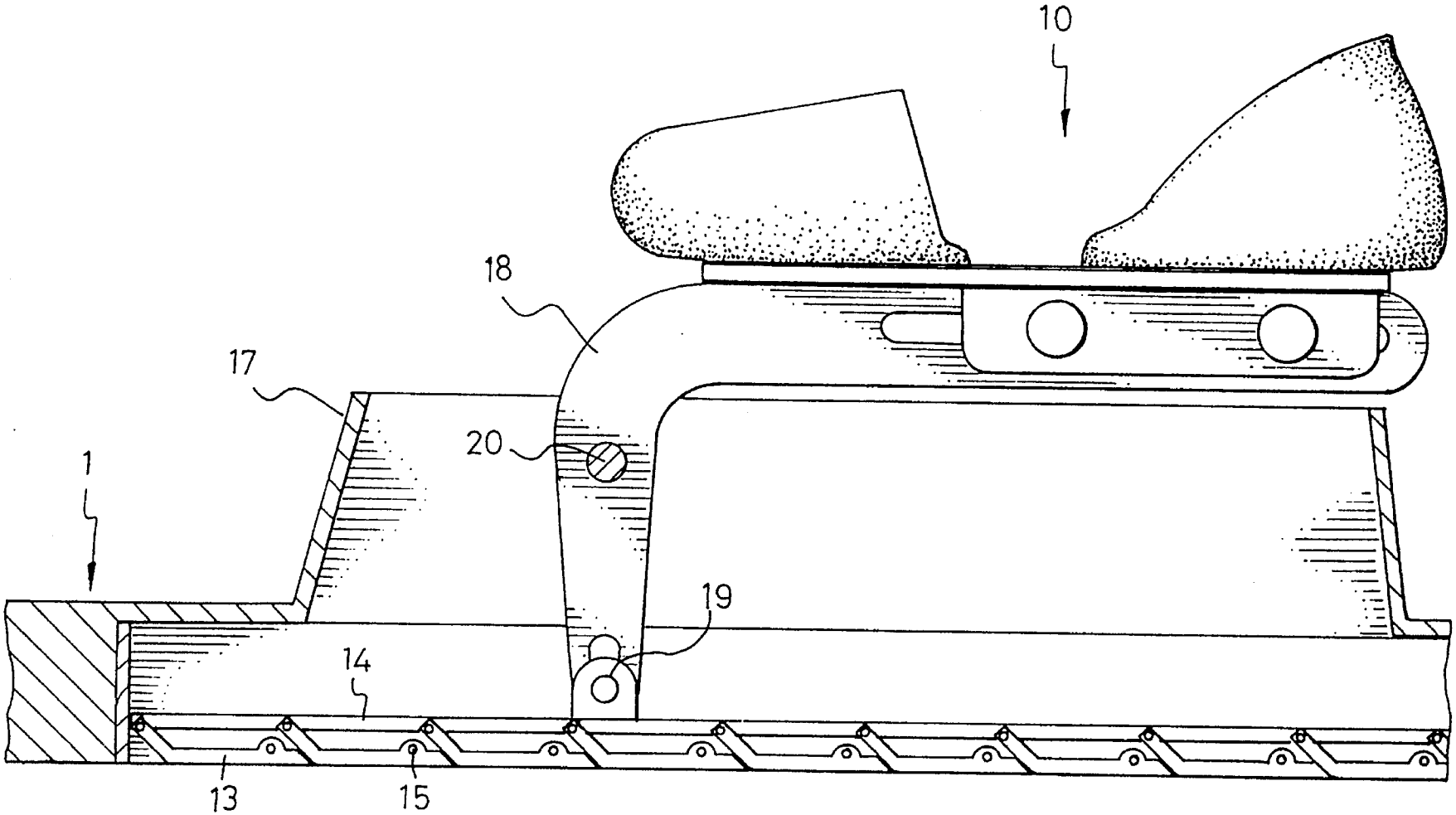
FIG. 7 is a cross-sectional view showing the anti-reverse sliding plate of the embodiment shown in FIG. 6 in the forward sliding position.
Figure 8:
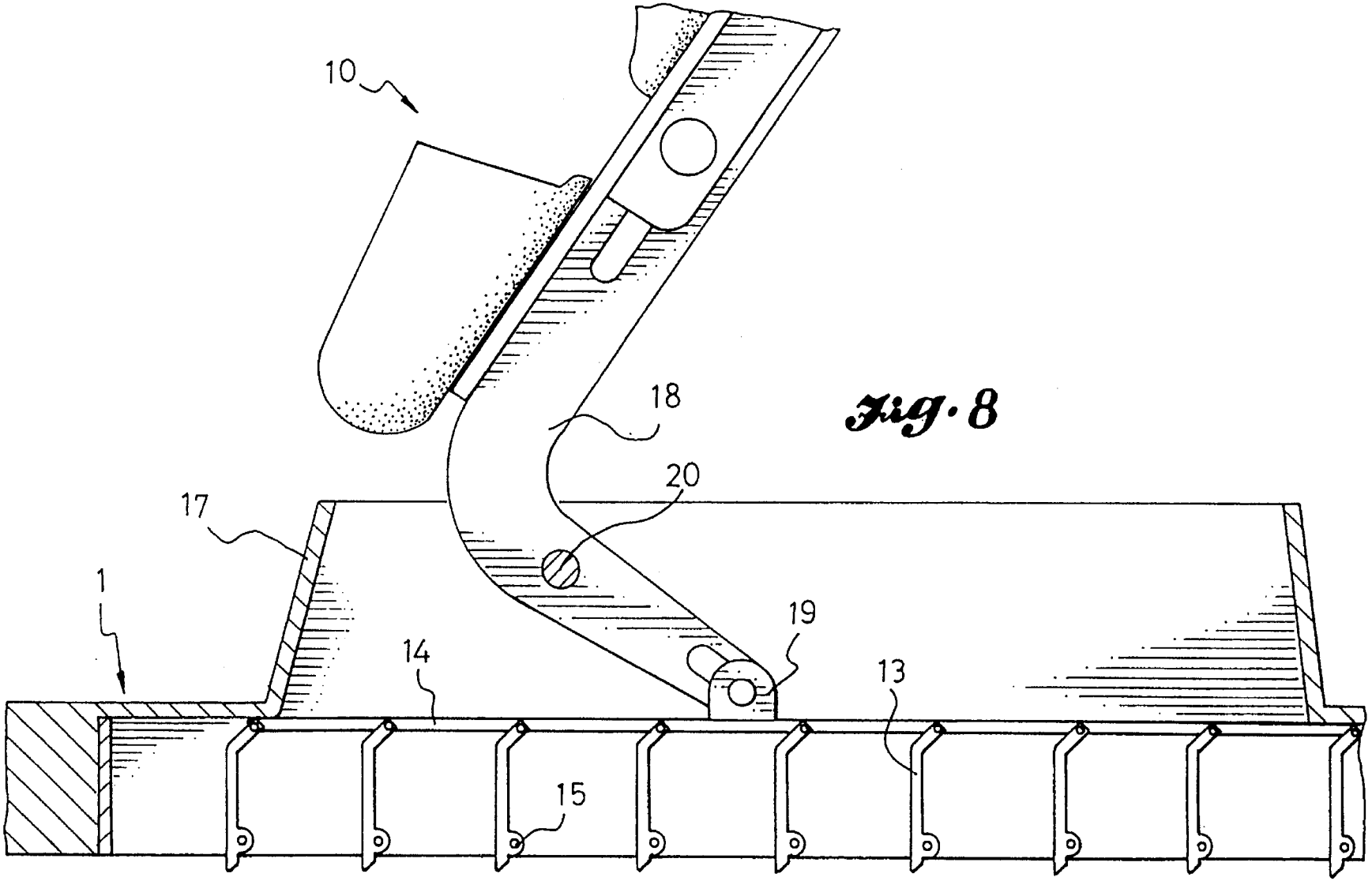
FIG. 8 is a cross-sectional view showing the anti-reverse sliding plate of the embodiment shown in FIG. 6 in the anti-reverse position.

Each of the anti-reverse sliding plates 13 can be linked to one another by a link so that the plates may act as a unit and move uniformly. As shown in FIGS. 4 and 5, an elongated connecting rod 14 is used to link each of the plates 13 at the top thereof. Consequently, as an external force is applied on the plates 13, all the plates 13 will move in unison to the horizontal or vertical positions to present the sliding or thrust surfaces (A), (B) respectively.

Besides, each of the anti-reverse sliding plate 13 is pivotally connected to the frame 16. Preferably, the pivot 15 is positioned adjacent to the smooth surface 11 so that as the anti-reverse sliding plates move to present the sliding surface (A), there will be no difference in height between the sliding surface and the smooth surface (11).

During motion over the ground, in particular the snow, due to the swinging action of the anti-reverse sliding plates 13, lumps of snow are often scraped up and deposited within the slot 18. The discharge openings 12 are thus provided to expel the lumps of snow or debris so as to reduce the resistance to the motion of the anti-reverse sliding plates 13.

Figure 9:
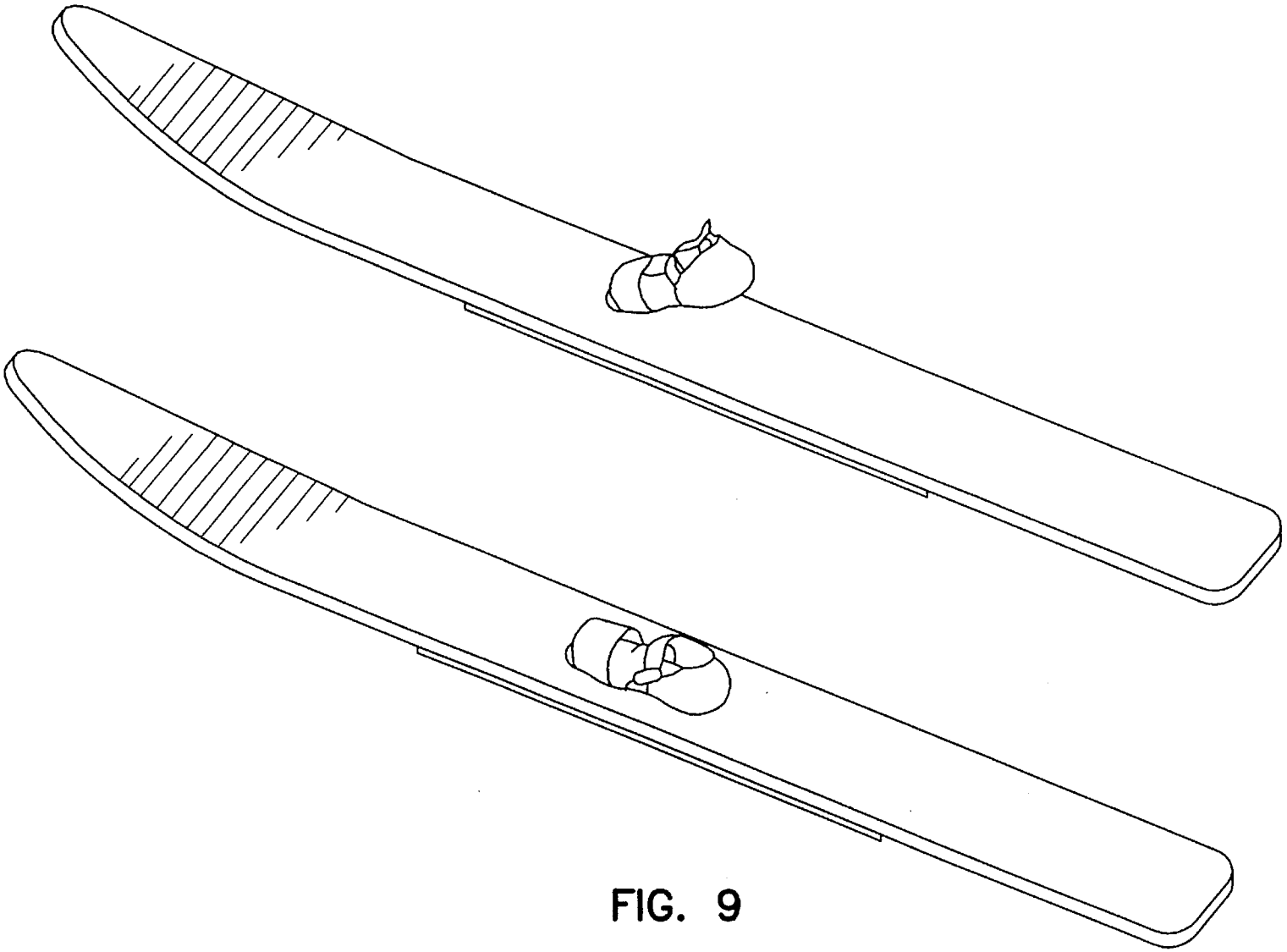
FIG. 9 is a perspective view of a further embodiment according to the present invention.
Figure 10:
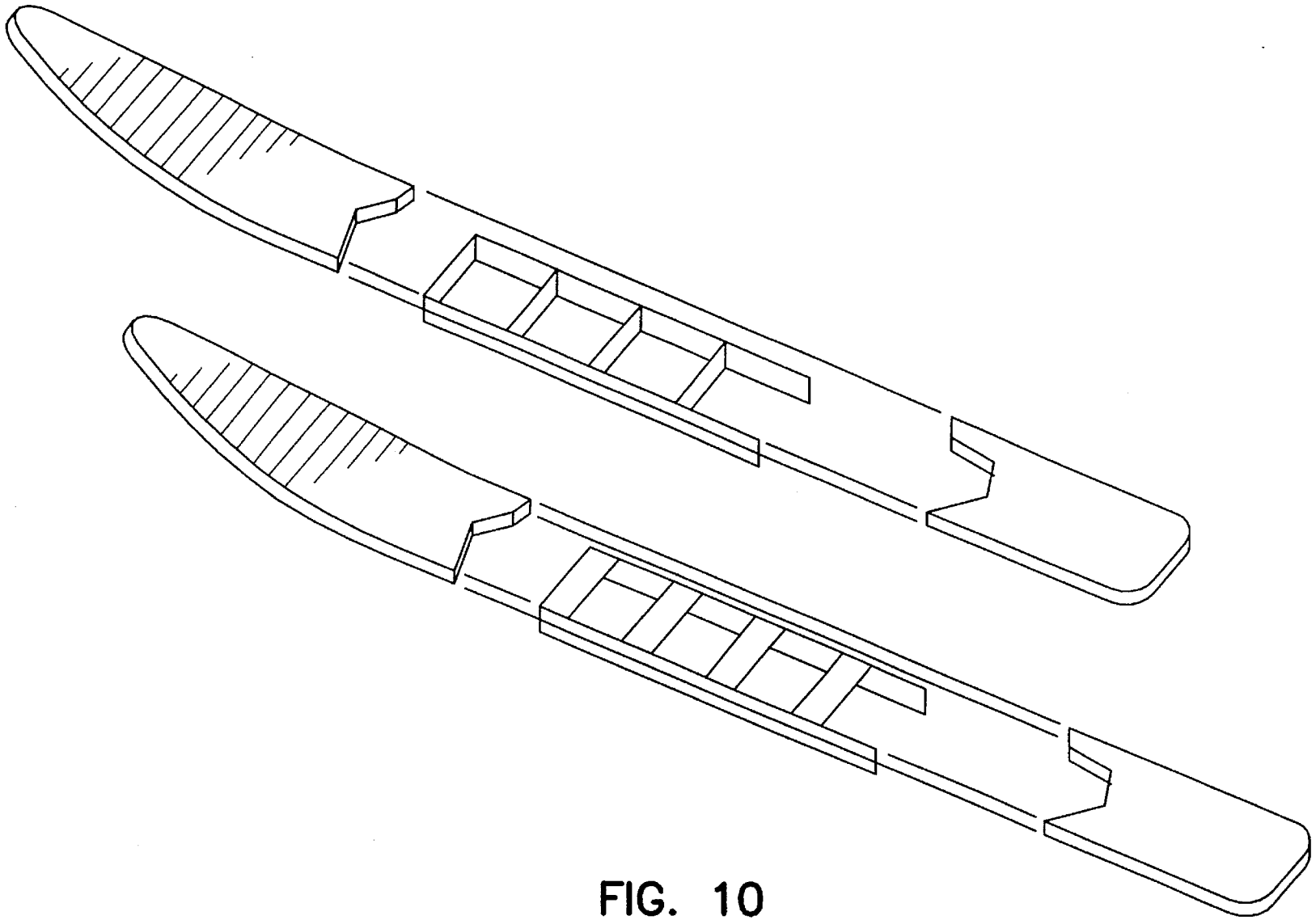
FIG. 10 is a perspective view illustrating the internal structure of the embodiment shown in FIG. 9.

FIGS. 9 and 10 show another modified embodiment of the present invention. In the embodiment, a plurality of guide, fins are provided at the bottom of the sliding carrier. The guide fins are disposed parallelly to the sliding direction and project slightly beyond the bottom of the carrier so as to prevent the carrier from sliding sideways.

While the invention has been described with respect to certain preferred embodiments, it is not intended to limit the scope of the invention thereby, but solely by the claims appended hereto.

What is claimed is:

1. An anti-reverse sliding device for use in a sliding carrier having a sliding surface on a bottom side of the sliding carrier, the anti-reverse sliding device comprising:

a frame defined in a bottom of the sliding carrier;

a plurality of anti-reverse sliding plates disposed within the frame and having a first pivot point on a first end of the sliding plates pivotally connecting the sliding plates to one another and a second pivot point on a second end of the sliding plates pivotally connecting the sliding plates to the sliding carrier, a poriton of the sliding plates extending beyond the second pivot point;

wherein the sliding plates have a range of motion between a first position and a second position, the sliding plates form a smooth surface flush with the sliding surface of the sliding carrier in the first position and the sliding plates form an anti-reverse sliding surface having the portion of the sliding plates extending beyond the second pivot point extending beneath the sliding surface of the sliding carrier in the second position; and wherein the second pivot point pivotally connects the sliding plates to the sliding carrier at a position near the bottom side of the siding carrier.

2. An anti-reverse sliding device according to claim 1, further comprising a plurality of discharge openings corresponding to the anti-reverse sliding plates provided on top of the sliding carrier so as to provide exits for debris scraped up by the anti-reverse sliding plates.

3. An anti-reverse sliding device according to claim 1, wherein the plurality of anti-reverse sliding plates are pivotally connected to one another by means of a connecting rod to perform a uniform swinging movement.

4. An anti-reverse sliding device according to claim 1, further comprising a foot retainer and a force applying lever pivotally connected to the anti-reverse sliding plates to allow the anti-reverse sliding plates to be moved by an user by varying an inclination of a force applying lever.

5. An anti-reverse sliding device according to claim 1, further comprising a plurality of guide fins provided at the bottom of the sliding carrier, wherein the guide fins are parallel to a movement direction of the carrier and project beyond the bottom of the sliding carrier so as to prevent the carrier from sliding sideways.

6. An anti-reverse sliding device according to claim 1, wherein the portion of the sliding plates extending beneath the sliding surface of the carrier extends in a direction substantially perpendicular to the sliding surface of the sliding carrier.

* * * * *